US010546541B2

(12) United States Patent
Tamura et al.

(10) Patent No.: US 10,546,541 B2
(45) Date of Patent: Jan. 28, 2020

(54) DISPLAY DEVICE AND ELECTRONIC APPARATUS

(71) Applicant: SEIKO EPSON CORPORATION, Tokyo (JP)

(72) Inventors: Tsuyoshi Tamura, Hara-mura (JP); Takeshi Nomura, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/432,501

(22) Filed: Feb. 14, 2017

(65) Prior Publication Data

US 2017/0244970 A1 Aug. 24, 2017

(30) Foreign Application Priority Data

Feb. 19, 2016 (JP) ..... 2016-029937

(51) Int. Cl.
*G09G 3/3275* (2016.01)

(52) U.S. Cl.
CPC ... *G09G 3/3275* (2013.01); *G09G 2300/0828* (2013.01); *G09G 2300/0857* (2013.01); *G09G 2310/027* (2013.01); *G09G 2310/0297* (2013.01); *G09G 2310/08* (2013.01)

(58) Field of Classification Search
CPC .. G09G 3/3275; G09G 3/3291; G09G 3/3233; G09G 2310/08; G09G 2300/0828; G09G 2310/027; G09G 2300/0857; G09G 2310/0297
See application file for complete search history.

(56) References Cited

U.S. PATENT DOCUMENTS 5,523,772 A * 6/1996 Lee ..... G09G 3/2011 345/100
5,619,225 A * 4/1997 Hashimoto ..... G09G 3/2011 345/88
5,648,792 A * 7/1997 Sato ..... G09G 3/3648 345/100
5,798,746 A * 8/1998 Koyama ..... G02F 1/13624 345/92
5,956,008 A * 9/1999 Kawasaki ..... G09G 3/3688 345/100

(Continued)

FOREIGN PATENT DOCUMENTS

JP 2003-177722 A 6/2003
JP 2005308857 A 11/2005

(Continued)

*Primary Examiner* — Grant Sitta
(74) *Attorney, Agent, or Firm* — Oliff PLC

(57) ABSTRACT

A drive circuit of a display device includes a plurality of latch circuits that latch grayscale data for each block, a plurality of conversion circuits that convert grayscale data latched in a plurality of latch circuits into a plurality of analog grayscale signals, a plurality of transmission paths that transmit the plurality of analog grayscale signals, a selection circuit that generates a plurality of selection signals for selecting data lines in one block in sequence out of the plurality of data lines, and an output circuit connected between a plurality of transmission paths and the data lines in each block and that outputs the plurality of analog grayscale signals to the data lines in one block selected in sequence by the plurality of selection signals.

12 Claims, 8 Drawing Sheets

(56) References Cited

U.S. PATENT DOCUMENTS 6,229,513 B1 * 5/2001 Nakano ..... G09G 3/3688 345/99
6,380,917 B2 * 4/2002 Matsueda ..... G09G 3/2011 345/210
6,697,037 B1 * 2/2004 Alt ..... G02F 1/1309 345/93
6,750,835 B2 * 6/2004 Azami ..... G09G 3/3275 345/89
7,659,878 B2 * 2/2010 Endou ..... G09G 3/3688 345/100
7,663,613 B2 * 2/2010 Tanaka ..... G09G 3/3688 345/204
8,115,752 B2 * 2/2012 Ijima ..... G06F 3/042 345/104
8,643,583 B2 * 2/2014 Yoshida ..... G09G 3/2085 345/100
8,723,763 B2 * 5/2014 Jeong ..... G09G 3/3233 345/82
9,847,063 B2 * 12/2017 Park ..... G09G 3/3614
2001/0022581 A1 * 9/2001 Koyama ..... G09G 3/3688 345/204
2002/0145602 A1 * 10/2002 Matsueda ..... G09G 3/2011 345/213
2003/0067434 A1 * 4/2003 Haga ..... G09G 3/3648 345/98
2003/0107564 A1 6/2003 Miyazawa
2005/0253835 A1 11/2005 Kawase
2005/0285842 A1 * 12/2005 Kang ..... G09G 3/3614 345/103
2006/0132420 A1 * 6/2006 Yoshida ..... G09G 3/3614 345/98
2007/0026583 A1 * 2/2007 Ikeda ..... G02F 1/13454 438/149
2007/0152947 A1 * 7/2007 Tanaka ..... G09G 3/3688 345/100
2007/0216631 A1 * 9/2007 Nojiri ..... G09G 3/3688 345/100
2007/0242016 A1 * 10/2007 Choi ..... G09G 3/3233 345/92
2007/0247932 A1 * 10/2007 Tobita ..... G09G 3/3677 365/189.12
2008/0062089 A1 * 3/2008 Kim ..... G09G 3/3275 345/76
2009/0189881 A1 * 7/2009 Ooishi ..... G09G 3/20 345/211
2011/0050741 A1 * 3/2011 Jeong ..... G09G 3/3233 345/690
2012/0127149 A1 * 5/2012 Suzuki ..... G09G 3/3614 345/212
2013/0093653 A1 * 4/2013 Ota ..... G09G 3/3233 345/77
2014/0062995 A1 * 3/2014 Kim ..... G09G 3/3688 345/214
2014/0285405 A1 9/2014 Nomura
2015/0042395 A1 * 2/2015 Yang ..... G09G 3/22 327/333
2015/0097852 A1 * 4/2015 Shibahara ..... G06T 1/60 345/561
2015/0262546 A1 * 9/2015 Ogura ..... G09G 3/3275 345/205
2015/0379910 A1 12/2015 Nishinohara et al.
2016/0042681 A1 2/2016 Tamura et al.

FOREIGN PATENT DOCUMENTS

JP 2007286572 A 11/2007
JP 2008070849 A 3/2008
JP 2009093104 A 4/2009
JP 2009187024 A 8/2009
JP 2011-053635 A 3/2011
JP 2013-160872 A 8/2013
JP 2013-190513 A 9/2013
JP 2014186083 A 10/2014
JP 2014186084 A 10/2014
JP 2014186125 A 10/2014
JP 2015-114399 A 6/2015
JP 2016-009165 A 1/2016

* cited by examiner

FIG. 6

| | RELATED ART | FIRST EMBODIMENT |
|---|---|---|
| CAPACITOR | 770 | 770 |
| SCANNER CIRCUIT | — | 200 |
| AMPLIFIER | 425 | 425 |
| DAC | 450 | 225 |
| LATCH CIRCUIT | 650 | 650 |
| DISPLAY CONTROL CIRCUIT | 900 | — |
| PAD | 1000 | 1000 |
| TOTAL | 4195 | 3270 |

(UNIT: $\mu m$)

DISPLAY DEVICE AND ELECTRONIC APPARATUS

BACKGROUND

1. Technical Field

The present invention relates to a display device using a display panel, such as an organic electro-luminescence (EL) panel, or the like. The invention also relates to an electronic apparatus including such a display device, or the like.

2. Related Art

In recent years, various proposals have been made of a display panel using a light emitting element, such as an organic light emitting diode (hereinafter referred to as an (organic light emitting diode (OLED)), or the like. In such a display panel, pixel circuits, each of which includes a light emitting element, a transistor, and the like, are disposed correspondingly to pixel positions at which scanning lines and data lines intersect. Also, a display device (Si-OLED) in which a drive circuit, and the like are mounted on a silicon backplane of a display panel is also being developed.

In an Si-OLED, a plurality of latch circuits, a plurality of digital-to-analog converters (DACs), and a plurality of amplifiers, and the like are mounted on a silicon chip that constitutes a silicon backplane. The grayscale data for one line, which was latched by the plurality of latch circuits, is converted into a plurality of analog signals by the plurality of DACs. Further, the plurality of analog signals are amplified by the plurality of amplifiers so that a plurality of grayscale signals are generated. The grayscale signals are used for driving a plurality of data lines of the display panel.

Also, a plurality of (about 3 to 18) data lines are sometimes driven by one amplifier in time division. This drive method is referred to as a demultiplexer driving method. By the demultiplexer driving method, it is possible to reduce the number of DACs and amplifiers compared with the case of providing a DAC and an amplifier for each data line.

In the demultiplexer driving method, it becomes necessary to have a data latch circuit that captures grayscale data for one line in sequence, and a line latch circuit that holds the grayscale data for one line, which has been captured in the data latch circuit, at the same time in order to drive a plurality of data lines. If those latch circuits are disposed separately, as the number of bits of grayscale data for one pixel increases, the number of wiring lines connecting those latch circuits increases. Accordingly, there arises a problem in that it becomes difficult to dispose a latch element that latches the grayscale data to be supplied to one pixel in the width of the one pixel of the display panel.

As the related art, JP-A-2014-186083 (paragraphs 0004 to 0011 and FIG. 1) discloses a latch circuit of a display device with the purpose of solving the above-described problem by changing the layouts of the data latch circuit and the line latch circuit. In the display device, data for M pixels are output for each pixel in time division in order to drive each of the M pixels that are in one line of the display panel on the basis of N-bit data. Also, N latch circuits are disposed in the column direction and M latch circuits are disposed in the row direction, and each of the latch circuits includes M×N one-bit latch circuits each of which latches one-bit data.

Each of the M×N one-bit latch circuits includes a data latch unit circuit that latches any one-bit data in the N bits at different timing for each row, a line latch unit circuit that latches the data from the data latch unit circuit at the same time for each row, and an output enable element that outputs the data from the line latch unit circuit on the basis of an enable signal that selects any one column. With JP-A-2014-186083, the data latch unit circuit and the line latch unit circuit are disposed adjacently, and thus it is possible to make the wiring line between both of the latch unit circuits shortest.

However, in the display device according to JP-A-2014-186083, it is also necessary to have a data latch circuit that captures grayscale data for one line in sequence, and a line latch circuit that simultaneously holds the grayscale data for one line, which has been captured by the data latch circuit, in order to drive a data line.

SUMMARY

An advantage of some aspects of the invention is that it reduces the number of latch circuits, and the like in order to reduce the chip size of a display device in which a drive circuit, and the like are mounted on a silicon backplane of a display panel. Also, an advantage of the other aspects of the invention is that it provides an electronic apparatus including such a display device, or the like.

According to a first aspect of the invention, there is provided a display device including at least a display section and a drive circuit mounted on a same semiconductor substrate, the display section provided with a plurality of data lines correspondingly to a plurality of columns of pixel circuits, the drive circuit including: in order to drive the plurality of data lines in sequence for each block, a plurality of latch circuits configured to latch grayscale data for each block; a plurality of conversion circuits provided correspondingly to a number of data lines in one block and configured to convert the grayscale data latched in the plurality of latch circuits into a plurality of analog grayscale signals, a plurality of transmission paths provided correspondingly to the number of data lines in one block and configured to transmit the respective plurality of grayscale signals; a selection circuit configured to generate a plurality of selection signals that select the data lines in one block in sequence out of the plurality of data lines; and an output circuit connected between the plurality of transmission paths and the data lines in each block, and configured to output the plurality of grayscale signals to the data lines in one block selected in sequence by the plurality of selection signals.

With the first aspect of the invention, the grayscale data latched by the plurality of latch circuits for each block is converted into a plurality of analog grayscale signals, and the plurality of data lines of the display section are driven for each block in sequence. Accordingly, it is possible to reduce the number of the latch circuits and the conversion circuits so as to reduce the chip size.

Here, the output circuit, the selection circuit, and the plurality of transmission paths may be disposed in a first area extending in a longitudinal direction of the display section, and a display control circuit that controls display timing in the display section, the plurality of conversion circuits, and the plurality of latch circuits may be disposed side by side in a second area and a third area that are adjacent to a first area on the opposite side of the display section. Thereby, it is possible to reduce the chip size in the direction perpendicular to the longitudinal direction of the display section by the width of the display control circuit, or the width of the plurality of conversion circuits and the plurality of latch circuits.

In the above, the plurality of latch circuits may include a first group of latch circuits disposed correspondingly to the number of data lines in one block and configured to capture grayscale data used for driving the data lines in one block in each of a plurality of predetermined periods in one horizontal synchronization period, and a second group of latch circuits disposed correspondingly to the number of data lines in one block and configured to hold the grayscale data output from the first group of latch circuits for each of the predetermined periods.

In this manner, by disposing the two stages of latch circuits, while the data line in one block is driven on the basis of the grayscale data held in the second group of latch circuits, it is possible for the first group of latch circuits to capture the grayscale data used for driving the data line of the next one block.

In that case, the plurality of conversion circuits may convert the grayscale data held in the second group of latch circuits into a plurality of analog grayscale signals for each of the predetermined period, the selection circuit may generate a plurality of selection signals that sequentially selects data lines in one block from the plurality of data lines for each of the predetermined period, and the output circuit may output the plurality of grayscale signals to data lines in one block selected in sequence by the plurality of selection signals for each of the predetermined period. Thereby, it is possible to write the grayscale signals for one line into the pixel circuits for one line of the display section in one horizontal synchronization period.

Also, the display device may further include a gate line drive circuit configured to generate a scanning signal on the basis of timing when the first group of latch circuits start capturing the grayscale data in one horizontal synchronization period. Thereby, even if the data enable signal is not activated in a blanking period, it is possible to generate change timing of the scanning signal in the drive circuit.

According to a second aspect of the invention, there is provided a display device including at least a display section and a drive circuit mounted on a same semiconductor substrate, the display device including: a plurality of data lines separated into blocks for each predetermined number of lines; and a pixel circuit connected to any one of the plurality of data lines and disposed in the display section, wherein the drive circuit includes the corresponding number of circuits to the predetermined number of lines, and a selection circuit configured to generate a selection signal that selects the plurality of data lines for each block, and each of the corresponding number of circuits to the predetermined number of lines includes a latch circuit configured to latch grayscale data, a conversion circuit configured to convert the grayscale data latched in the latch circuit into an analog grayscale signal, a transmission path for transmitting the grayscale signal, and an output circuit connected between any one of the data lines in the plurality of data lines and the transmission path, and controlled by the selection signal.

With the second aspect of the invention, the number of latch circuits, conversion circuits, transmission paths, and output circuits that correspond to the number of data lines in one block are disposed so that a plurality of data lines are selected and driven for each block. Accordingly, it is possible to reduce the number of latch circuits and conversion circuits so as to reduce the chip size.

According to a third aspect of the invention, there is provided an electronic apparatus including any of the above-described display devices. With the third aspect of the invention, it is possible to reduce the size or the cost of the electronic apparatus using a display device having a chip size reduced by reducing the number of latch circuits, and the like.

BRIEF DESCRIPTION OF THE DRAWINGS

The invention will be described with reference to the accompanying drawings, wherein like numbers reference like elements.

FIG. 6 is a diagram illustrating a comparison between the width of each section of the display device according to the first embodiment and that of the related-art display device.

DESCRIPTION OF EXEMPLARY EMBODIMENTS

In the following, a detailed description will be given of an embodiment of the invention with reference to the drawings. In this regard, the same reference symbol is given to the same component, and the duplicated description will be omitted.

Display Device

Figure 1:
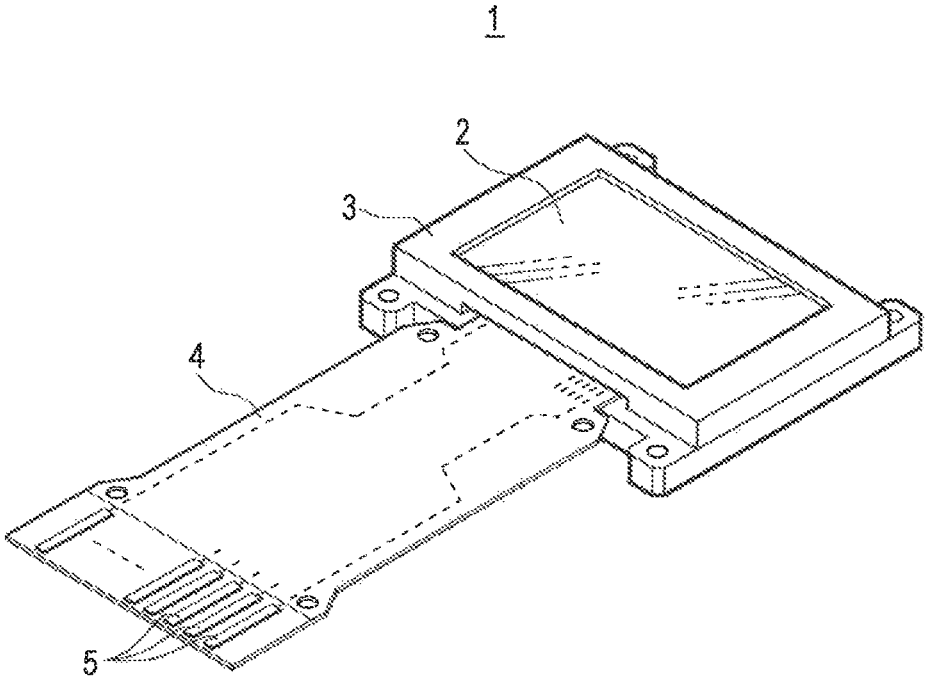
FIG. 1 is a perspective view illustrating a display device according to each embodiment of the invention.

FIG. 1 is a perspective view illustrating an outer view of a display device according to each embodiment of the invention. The display device 1 is a micro display that displays an image in a head mounted display, for example.

As illustrated in FIG. 1, the display device 1 includes a display panel 2, such as an organic EL panel, or the like, a case 3, and a flexible printed circuit (FPC) board 4. For example, the display panel 2 is contained in the frame-shaped case 3 having an opening formed in the display section, and is connected to the FPC board 4. The FPC board 4 is provided with a plurality of terminals 5 for connection with an external device (refer to FIG. 2), such as a host CPU, or the like.

The display panel 2 is disposed on a silicon backplane (silicon chip) and includes a plurality of pixel circuits of an active matrix system. Each of the pixel circuits includes a light emitting element, such as an OLED, or the like and a plurality of transistors, and the like. Also, the silicon backplane is provided with a drive circuit that drives those pixel circuits, and the like.

First Embodiment

Figure 2:
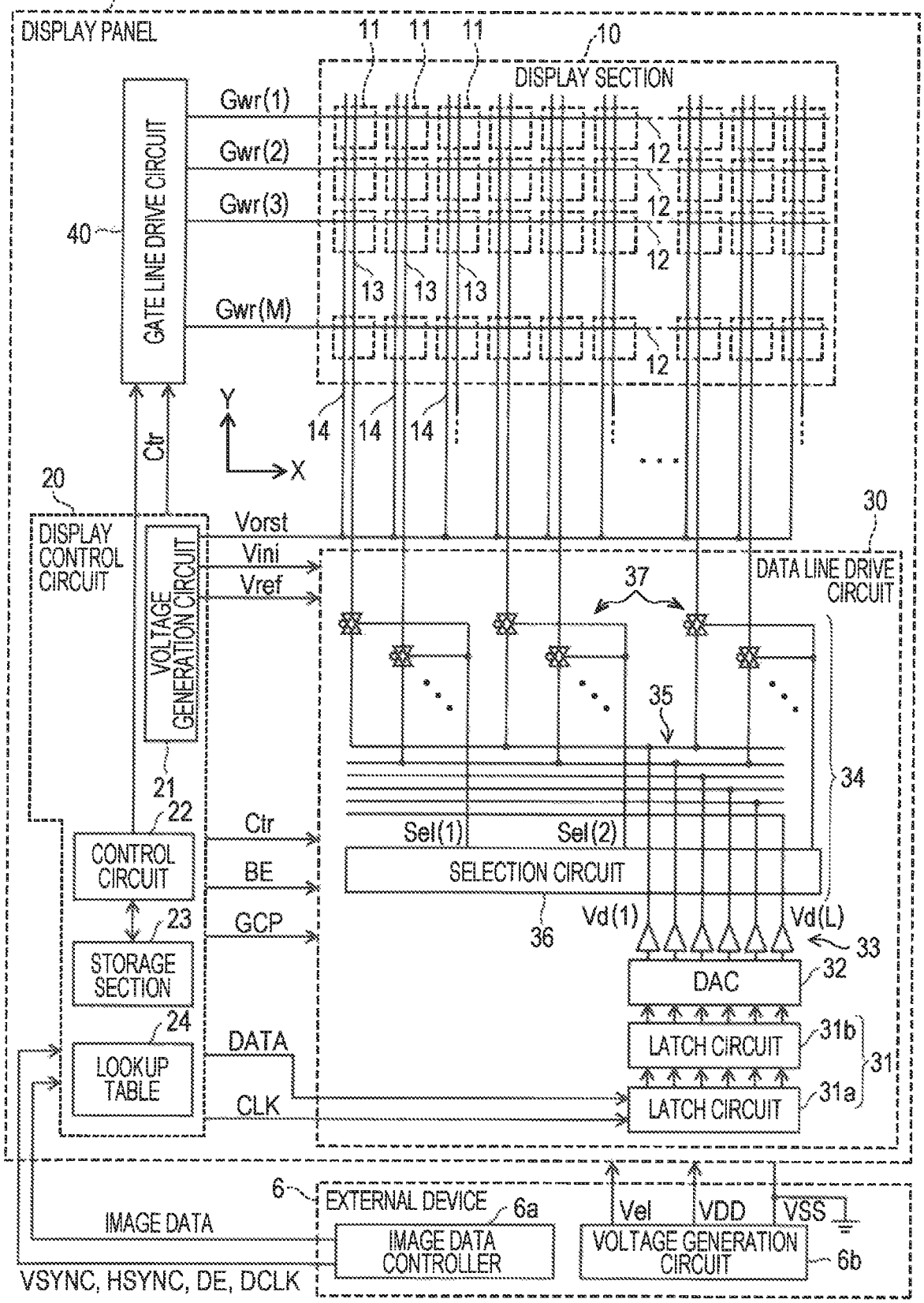
FIG. 2 is a block diagram illustrating an example of a configuration of a display device according to a first embodiment of the invention.

FIG. 2 is a block diagram illustrating an example of a configuration of a display device according to a first embodiment of the invention. FIG. 2 illustrates the display panel 2 and an external device 6. The display panel 2 includes a display section 10, a display control circuit 20, a data line drive circuit (source driver) 30, and a gate line drive circuit (gate driver) 40. The display control circuit 20 to the gate line drive circuit 40 are disposed on the silicon backplane of the display panel 2.

The display section 10 includes a plurality of pixel circuits 11. The pixel circuits 11 are arranged in a two-dimensional matrix with M rows and 3N columns correspondingly to each of the three types of pixels (dots) of red (R), green (G) and blue (B) (M and N are integers of two or more), for example.

In the display section 10, M scanning lines 12 are disposed in the extending manner in a first direction (the X-axis direction in FIG. 2) correspondingly to the M-row pixel circuits 11 respectively. Also, 3N data lines 13 are disposed in the extending manner in a second direction (the Y-axis direction in FIG. 2) perpendicular to the first direction correspondingly to the 3N-column pixel circuits 11 respectively. Further, 3N reset lines 14 are disposed in the extending manner in the second direction correspondingly to the 3N-column pixel circuits 11 respectively. Each of the reset lines 14 is provided with a predetermined reset potential Vorst.

The display control circuit 20 includes, for example a logic circuit, or the like including a combinational circuit or a sequential circuit, and controls the display timing of the display section 10. The display control circuit 20 is supplied with image data from an image data controller 6*a* of the external device 6 in synchronism with a synchronization signal. The image data may be image data in the RGB format including the three color components (for example, 8 bits for each color component) of red (R), green (G) and blue (B). Also, the synchronization signal may include a vertical synchronization signal VSYNC, a horizontal synchronization signal HSYNC, a data enable signal DE, and a data clock signal DCLK.

The display control circuit 20 generates grayscale data DATA on the basis of the supplied image data, and supplies the grayscale data DATA to the data line drive circuit 30 in synchronism with a clock signal CLK for taking in the data. For example, the display control circuit 20 is provided with a lookup table 24 in which the luminance (grayscale level) of the light emitting element in the display section 10 and the grayscale data DATA are stored in association with each other. The display control circuit 20 generates the grayscale data DATA corresponding to the grayscale level indicated by the supplied image data by referring to the lookup table 24.

Also, the display control circuit 20 supplies a control signal Ctr for controlling various kinds of timing to the data line drive circuit 30 and the gate line drive circuit 40. For example, the control signal Ctr may include a vertical synchronization signal, a horizontal synchronization signal, a data enable signal, or a bus enable signal, and the like. The data line drive circuit 30 and the gate line drive circuit 40 display an image to the display section 10 on the basis of the grayscale data DATA and the control signal Ctr, and the like supplied from the display control circuit 20.

The display control circuit 20 includes a voltage generation circuit 21. The voltage generation circuit 21 generates various potentials, and supplies the potentials to the data line drive circuit 30, and the like. For example, the voltage generation circuit 21 generates the reset potential Vorst, an initialization potential Vini supplied to the data lines 13, and a reference potential Vref supplied to a capacitor (not illustrated in FIG. 2), and the like. A power source potential Vel of the high potential side, a logic power source potential VDD, and the like in the display section 10, the data line drive circuit 30, and the gate line drive circuit 40 are supplied from the voltage generation circuit 6*b* of the external device 6. Further, the display control circuit 20 may include a control circuit 22 and a storage section 23.

The data line drive circuit 30 includes a plurality of latch circuits 31, a plurality of DACs (D/A converters) 32, a plurality of amplifiers 33, and a scanner circuit 34. The data line drive circuit 30 divides the 3N data lines 13 into a plurality of blocks and drives the plurality of blocks in time division in order to write the grayscale signals into the 3N pixel circuits 11 included in one row. It is assumed that one block includes L data lines (L is an integer of 2 to (3N/2)).

For example, if N=1944, 5832 data lines are divides into 54 blocks, and one block includes 108 data lines (L=108). The 108 data lines include 36 data lines for red (R), 36 data lines for green (G), and 36 data lines for blue (B).

The plurality of latch circuits 31 are formed by a plurality of D-type flip-flops, and the like, for example. The plurality of latch circuits 31 latch the grayscale data DATA for each block in order to sequentially drive the plurality of data lines 13 for each block. As illustrated in FIG. 2, the plurality of latch circuits 31 may include a first group of latch circuits 31*a* and a second group of latch circuits 31*b*.

The first group of latch circuits 31*a* are disposed correspondingly to the number (L) of data lines in one block, and sequentially captures the grayscale data DATA that is used for driving data lines in one block in each of a plurality of predetermined periods in one horizontal synchronization period in synchronism with the clock signal CLK. For example, if the number of bits for each color of the grayscale data DATA is K bits, the first group of latch circuits 31*a* is formed by L K-bit latch circuits.

The second group of latch circuits 31*b* are disposed correspondingly to the number (L) of data lines in one block, and holds the grayscale data DATA that is output from the first group of latch circuits 31*a* for a predetermined period. For example, if the number of bits for each color of the grayscale data DATA is K bits, the second group of latch circuits 31*b* are formed by L K-bit latch circuits.

In this manner, by providing two stages of latch circuits, while data lines in one block are driven on the basis of the grayscale data DATA held in the second group of latch circuits 31*b*, it is possible for the first group latch circuits 31*a* to capture the grayscale data DATA used for driving the data lines in the next one block.

Also, L DACs 32 and L amplifiers 33 are disposed correspondingly to the number(L) of data lines in one block. The L DACs 32 convert the grayscale data DATA latched in the plurality of latch circuits 31 into L analog signals. For example, the L DACs 32 converts the grayscale data DATA output from the second group of latch circuit 31*b* into L analog signals.

The L amplifiers 33 amplify the L analog signals output from the L DACs 32 and generate the L grayscale signals Vd(1) to Vd(L) respectively. Here, the DACs 32 and the amplifiers 33 correspond to the conversion circuits that convert the grayscale data latched in the latch circuits 31 into analog grayscale signals.

The scanner circuit 34 includes L transmission paths 35, selection circuits 36, and output circuits 37, which are disposed correspondingly to the number (L) of data lines in one block. The L transmission paths 35 are constituted by L wiring lines (bus lines), such as aluminum (Al), copper (Cu), or the like formed on a silicon substrate through an insulation film, for example, and transmit the L grayscale signals output from the L amplifiers 33.

The selection circuit 36 is constituted by, for example, a shift register, a decoder, and the like, and generates a plurality of selection signals Sel(1), Sel(2), . . . that sequentially select the data lines in one block within the plurality of data lines 13.

The output circuits 37 are constituted by a plurality of switch circuits, for example, transmission gates, and the like, and are connected between the L transmission paths 35 and the data lines in each block. The output circuits 37 output the L grayscale signals to the data lines in one block that is sequentially selected by the plurality of selection signals Sel(1), Sel(2), . . . . In this application, the data line drive method as described above is referred to as a scan drive method. In this regard, in FIG. 2, inverted selection signals that are supplied to the switch circuits are omitted.

The control circuit 22 stores information regarding the activation timing of the data enable signal DE, which is supplied from the image data controller 6*a* of the external device 6, into the storage section 23. The control circuit 22 generates a scan timing signal indicating a change timing of the scanning signals on the basis of the information stored in the storage section 23, and supplies the signal to the gate line drive circuit 40. For example, the control circuit 22 is constituted by a logic circuit including a combinational circuit, a sequential circuit, or the like, and the storage section 23 is constituted by a memory, a register, and the like.

The gate line drive circuit 40 is formed by, for example a logic circuit including a combinational circuit, a sequential circuit, or the like. The gate line drive circuit 40 generates M scanning signals Gwr(1) to Gwr(M) in order to sequentially drive the M scanning lines 12 in one vertical synchronization period in accordance with the control signal Ctr or the scan timing signal. Here, one vertical synchronization period refers to a period required by the display section 10 to display one unit of an image (one frame period). Also, the gate line drive circuit 40 generates various control signals in synchronism with the scanning signal for each row in addition to the scanning signal, and supplies the control signals to the control lines (refer to FIG. 3).

Example of Configuration of Pixel Circuit

Figure 3:
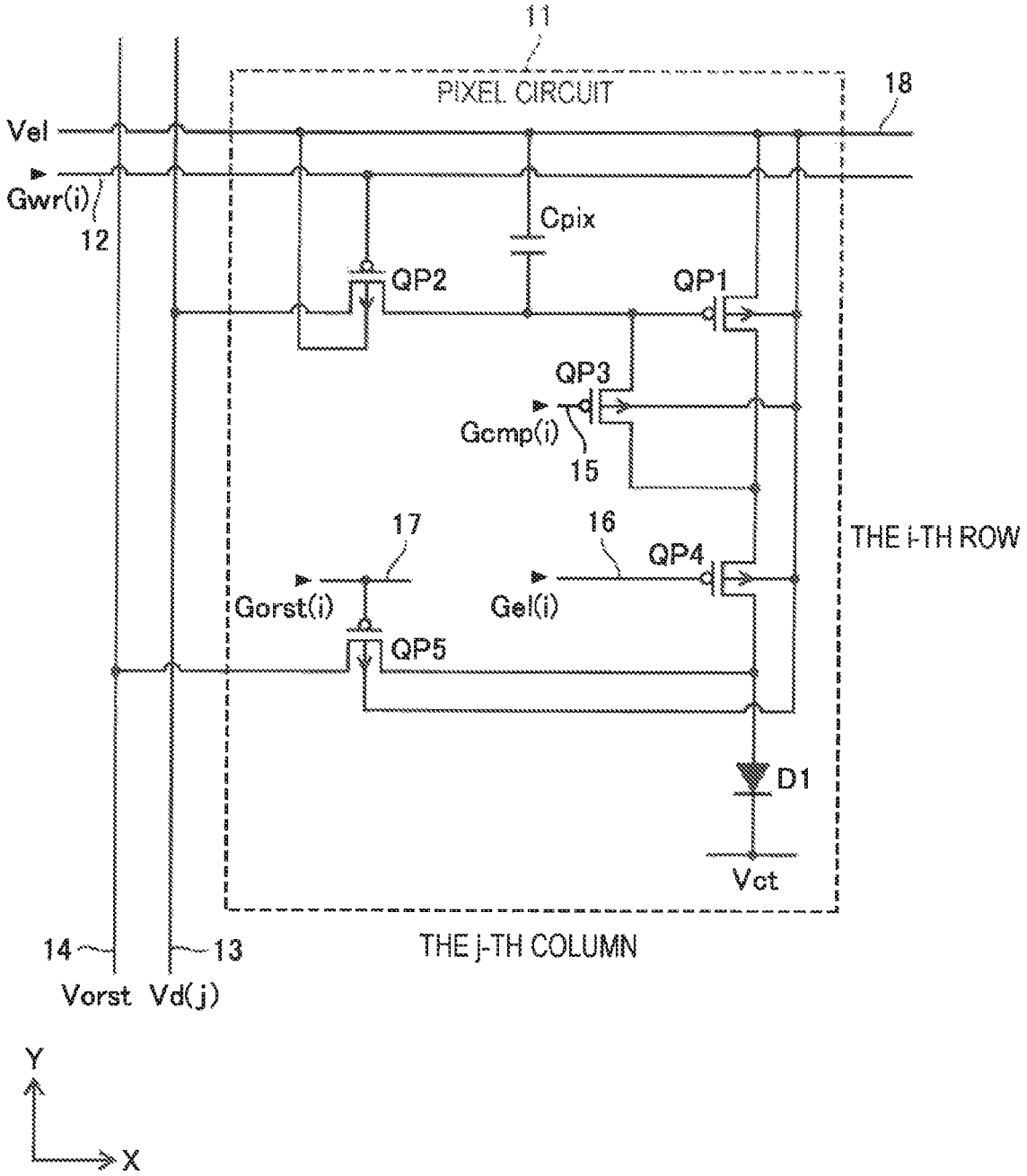
FIG. 3 is a circuit diagram illustrating an example of a configuration of the pixel circuit illustrated in FIG. 2.

FIG. 3 is a circuit diagram illustrating an example of a configuration of the pixel circuit illustrated in FIG. 2. The plurality of pixel circuits have the same circuit configuration, and thus FIG. 3 illustrates an example of a configuration of one pixel circuit located at the i-th row and the j-th column. In this regard, although not illustrated in FIG. 2, three control lines 15 to 17 are disposed in the extending manner in the first direction (the X-axis direction in FIG. 3) in parallel with each of the scanning lines 12 on which the scanning signal Gwr(i) is supplied. Each of the pixel circuits 11 is electrically connected to one scanning line 12 on which the scanning signal Gwr(i) is supplied, one data line 13, one reset line 14, three control lines 15 to 17, and one power feed line 18.

In the example illustrated in FIG. 3, the pixel circuit 11 includes a light emitting element D1, a P-channel MOS transistors QP1 to QP5, and a holding capacitor Cpix. The light emitting element D1 is an OLED in which a white organic EL layer is sandwiched between an anode formed on a silicon substrate and a cathode having optical transparency, for example. The anode of the light emitting element D1 is a pixel electrode separately disposed for each pixel circuit. On the other hand, the cathode of the light emitting element D1 is a common electrode disposed in common with all the pixel circuits, and is kept to have a power source potential Vct at the low potential side of the display section 10.

The emission side (cathode side) of the light emitting element D1 is provided with a color filter corresponding to any one of RGB. In this regard, the optical path length between the two reflective layers sandwiching a white organic EL layer may be adjusted to form a cavity structure, and the wavelength of the light emitted from the light emitting element D1 may be set. In this case, a color filter may be provided or may not be provided.

In such a light emitting element D1, when a current flows from the anode to the cathode, a positive hole injected from the anode and an electron injected from the cathode are recombined in the organic EL layer to generate an exciton, and thereby white light occurs. The white light that has occurred at this time passes through the cathode that is located at the opposite side of the silicon substrate (anode), get colored by the color filter, and is emitted from the display section 10.

The gate line drive circuit 40 illustrated in FIG. 2 supplies the scanning signal Gwr(i) to the scanning line 12 of the i-th row. Also, the gate line drive circuit 40 supplies a control signal Gcmp(i) to the control line 15 of the i-th row, supplies a control signal Gel(i) to the control line 16 of the i-th row, and supplies a control signal Gorst(i) to the control line 17 of the i-th row.

One of the source and the drain of the transistor QP2 is electrically connected to the data line 13, and the other of the source and the drain is electrically connected to one of the electrodes of the holding capacitor Cpix and the gate of the drive transistor QP1. The gate of the transistor QP2 is electrically connected to the scanning line 12 and is supplied with the scanning signal Gwr(i). The transistor QP2 functions as a switching transistor that controls the electrical connection between the data line 13 and the gate of the drive transistor QP1.

The other of the electrodes of the holding capacitor is electrically connected to the power feed line 18 on which the high potential side of the power source potential Vel is supplied in the display section 10. Thereby, the holding capacitor Cpix functions as the capacitance that holds the voltage across the gate and the source of the drive transistor QP1.

The source of the drive transistor QP1 is electrically connected to the power feed line 18, and the drain thereof is electrically connected to the source of the transistor QP4. The drive transistor QP1 causes the drain current to flow in accordance with the voltage across the source and the gate so as to drive the light emitting element D1.

The source and the drain of the transistor QP3 is electrically connected between the gate and the drain of the drive transistor QP1. The gate of the transistor QP3 is electrically connected to the control line 15, and is supplied with the control signal Gcmp(i). The transistor QP3 functions as a switching transistor that controls electrical connection between the gate and the drain of the drive transistor QP1. In this regard, the transistor QP3 may be connected between the data line 13 and the drain of the drive transistor QP1.

The drain of the transistor QP4 is electrically connected between the anode of the light emitting element D1 and the source of the transistor QP5. The gate of the transistor QP4 is electrically connected to the control lines 16, and is supplied with the control signal Gel(i). The transistor QP4 functions as a switching transistor that controls electrical connection between the drain of the drive transistor QP1 and the anode of the light emitting element D1.

The drain of the transistor QP5 is electrically connected to the reset line 14, and is kept at the reset potential Vorst. The gate of the transistor QP5 is electrically connected to the control line 17, and is supplied with the control signal Gorst(i). The transistor QP5 functions as a switching transistor that controls electrical connection between the reset line 14 and the anode of the light emitting element D1.

In FIG. 3, P-channel MOS transistors are used in the pixel circuit 11, but N-channel MOS transistors may be used in place of the P-channel MOS transistors. If N-channel MOS transistors are used in the pixel circuit 11, a connection relationship between the source and the drain of the transistors becomes inverted, and the polarities of the scanning signal, the control signal, and the grayscale signal become inverted. Alternatively, the P-channel MOS transistors and the N-channel MOS transistors may be suitably used in combination. Also, the transistors in the pixel circuit 11 may be thin film transistors.

As the holding capacitor Cpix, parasitic capacitance accompanying the gate of the drive transistor QP1 may be used. Alternatively, as the holding capacitor Cpix, a capacitor that is formed by sandwiching an interlayer insulation film with the wiring lines in a plurality of different wiring line layers disposed on a silicon substrate may be used.

Example of Operation of Display Device

Figure 4:
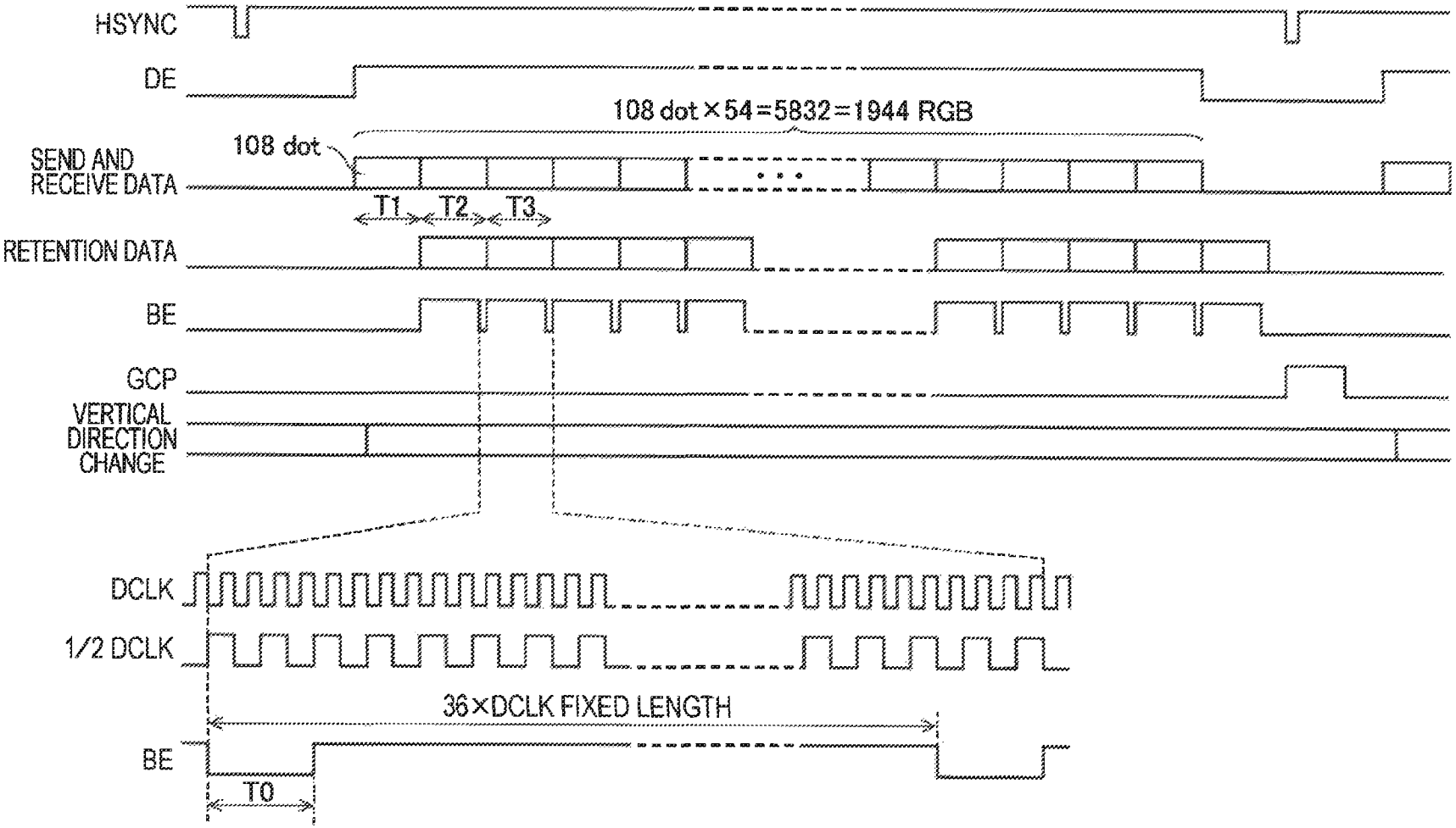
FIG. 4 is a timing chart illustrating an example of operation of the display device illustrated in FIG. 2 and FIG. 3.

A description will be given of an example of operation of the display device illustrated in FIG. 2 and FIG. 3 with reference to FIG. 4. FIG. 4 is a timing chart illustrating an example of operation of the display device illustrated in FIG. 2 and FIG. 3. FIG. 4 illustrates timing of capturing grayscale data, retention timing of grayscale data for driving the amplifier, and an enable signal for scan driving, and the like when an Si-OLED of a full HD class is driven by a scan drive method.

The display control circuit 20 receives input of image data, the synchronization signals (the vertical synchronization signal VSYNC, the horizontal synchronization signal HSYNC, the data enable signal DE, and the data clock signal DCLK) from the external device 6, and transmits the grayscale data DATA and the clock signal CLK for use in taking in the data to the data line drive circuit 30.

In the example in FIG. 4, in each of a plurality of predetermined periods T1, T2, T3, . . . in one horizontal synchronization period, the grayscale data DATA for 108 dots included in one block is transmitted. Thereby, 108 dots×54 times=5832 dots, that is to say, the grayscale data DATA for 1944 dots for each of RGB is transmitted in one horizontal synchronization period. The grayscale data DATA transmitted from the display control circuit 20 is arranged in order of the pixels.

In one period of the data clock signal DCLK, the grayscale data DATA for three dots (RGB) is sent and received, and thus each of the predetermined periods T1, T2, T3, . . . has a fixed length 36 times the period of the data clock signal DCLK.

In each of the plurality of predetermined periods T1, T2, T3, . . . in one horizontal synchronization period, the first group of latch circuits 31*a* receive and capture the grayscale data to be used for driving the data lines in one block. For example, in the predetermined period T1, the first group of latch circuits 31*a* capture the grayscale data DATA for the 108 dots of the first block in synchronism with a rising edge of the clock signal CLK.

A bus enable signal BE is activated to a high level when the first period T1 ends and the second period T2 starts, and is deactivated to the low level in advance of a period T0 before the second period T2 ends. The period T0 is capable of being adjusted using a divided clock signal ½ DCLK that is obtained by dividing the data clock signal DCLK at a frequency division rate of ½. After that, the bus enable signal BE is activated for each predetermined period by the end of writing the grayscale signals to the pixel circuits 11 for one line.

In the second period T2, the second group of latch circuits 31*b* hold, in synchronism with a rising edge of the bus enable signal BE, the grayscale data DATA for 108 dots of the first block that is output from the first group of latch circuits 31*a*. After that, the first group of latch circuits 31*a* capture the grayscale data DATA for 108 dots of the second block in synchronism with a rising edge of the clock signal CLK.

When the bus enable signal BE is activated, the 108 DACs 32 convert the grayscale data DATA held in the second group of latch circuits 31*b* to 108 analog signals. Also, the 108 amplifiers 33 individually amplify the 108 analog signals that are output from the 108 DACs 32, and generate 108 grayscale signals. Thereby, the 108 DACs 32 and the 108 amplifiers 33 convert the grayscale data DATA that is held in the second group of latch circuits 31*b* for each predetermined period to 108 analog grayscale signals.

The selection circuit 36 generates the plurality of selection signals Sel(1), Sel(2), . . . that sequentially select the data lines in one block within the plurality of data lines 13 for each predetermined period. Also, the output circuits 37 output the 108 grayscale signals to the data lines in one block that are sequentially selected by the plurality of selection signals Sel(1), Sel(2), . . . for each predetermined period.

For example, in the second period T2, if the bus enable signal BE is activated, the selection circuit 36 activates the selection signal Sel(1) that selects the data lines in the first block out of the plurality of data lines 13. Thereby, the 108 switch circuits connected between the 108 transmission paths 35 and the data lines in the first block are turned on in the output circuits 37, and 108 grayscale signals Vd(1) to Vd(108) are output to the data lines in the first block.

In this manner, in the second period T2, the data lines from the first column to the 108-th column included in the first block are driven. In the third period T3, the data lines from the 109-th column to the 216-th column included in the second block are driven. The operations described above are repeated in the third period T3 and a plurality of predetermined periods subsequent to the third period T3.

Thereby, it is possible to write the grayscale signals for one line to the pixel circuits 11 for one line in the display section 10 in one horizontal synchronization period. In FIG. 4, a signal GCP denotes a timing at which writing of the grayscale signals for one line has been completed. Also, a "vertical direction change" denotes a timing when the row of the pixel circuits 11 in which the grayscale signals are written is changed.

Here, the DACs 32 to the scanner circuit 34 do not operate in synchronism with the activation timing of the horizontal synchronization signal HSYNC, but sequentially starts driving the data lines 13 in a plurality of blocks from when the first group of latch circuits 31*a* start capturing the grayscale data DATA in one horizontal synchronization period. Accordingly, if the capturing of the grayscale data DATA is carried out until close to the point in time of the completion of one horizontal synchronization period, a period of driving the data lines in the 3N-th column overlaps the next horizontal synchronization period.

Thus, if the first group of latch circuits 31*a* capture the grayscale data DATA in synchronism with the activation timing of the external data enable signal DE, it is necessary for the gate line drive circuit 40 to generate the scanning signal Gwr not in synchronism with an activation timing of the horizontal synchronization signal HSYNC, but in synchronism with an activation timing of the data enable signal DE.

However, the image data controller 6*a* normally does not deactivate the data enable signal DE in the blanking period. In that case, the control circuit 22 generates a scan timing signal that indicates the change timing of scanning signals on the basis of the activation timing of the data enable signal DE supplied from the image data controller 6*a* so as to control generation of the scan signal Gwr.

In this manner, the gate line drive circuit 40 generates the scanning signal Gwr on the basis of the timing when the first group of latch circuits 31*a* start capturing the grayscale data DATA in one horizontal synchronization period. Thereby, even if the data enable signal DE is not activated in the blanking period, it is possible to generate a change timing of the scanning signal Gwr inside the display control circuit 20.

Referring back to FIG. 3 again, it is assumed that in an initial state, the scanning signal Gwr(i), the control signal Gcmp(i), and the control signal Gorst(i) are deactivated to the high level, and the control signal Gel(i) is activated at the low level. Accordingly, the transistors QP2, QP3, and QP5 are in the off state, and the transistor QP4 is in the on state.

When the i-th horizontal synchronization period starts in one vertical synchronization period, the gate line drive circuit 40 illustrated in FIG. 2 activates the control signal Gorst(i) that is supplied to the i-th row control line 17 to the low level, and deactivates the control signal Gel(i) that is supplied to the i-th row control line 16 to the high level. Thereby, the transistor QP5 becomes the on state, the transistor QP4 becomes the off state, and the light emitting element D1 of the i-th row pixel circuit 11 becomes the reset state (initialization period).

Next, the gate line drive circuit 40 activates the scanning signal Gwr(i) that is supplied to the i-th row scanning line 12 to the low level, and activates the control signal Gcmp(i) that is supplied to the i-th row control lines 15 to the low level. Thereby, the transistors QP2 and QP3 become the on state, and the gate potential of the drive transistor QP1 is set to a fixed value (compensation period). After that, the control signal Gcmp(i) is deactivated to the high level again, and the transistor QP3 becomes the off state.

Next, in the second period T2 illustrated in FIG. 4, the 108 switch circuits connected to the data lines 13 in the first block are turned on, and the data line drive circuit 30 outputs the grayscale signals Vd(1) to Vd(108) to the data lines 13 of the first column to the 108 column. Thereby, in the pixel circuits 11 in the first block, the grayscale signal is applied to the gate of the drive transistor QP1, and the holding capacitor Cpix is charged to the grayscale voltage (the writing period of the first block).

Next, in the third period T3, the 108 switch circuits connected to the data lines 13 in the second block are turned on, and the data line drive circuit 30 outputs the grayscale signals Vd(109) to Vd(216) to the data lines 13 of the 109-th column to the 216-th column. Thereby, in the pixel circuits 11 in the second block, the grayscale signal is applied to the gate of the drive transistor QP1, and the holding capacitor Cpix is charged to the grayscale voltage (the writing period of the second block).

In the same manner, in the fourth period to the 55-th period, the switch circuits connected to the data lines 13 in the third block to the 54-th block are sequentially turned on, and the data line drive circuit 30 outputs the grayscale signals Vd(217) to Vd(5832) to the data lines 13 of the 217-th column to the 5832-th column. Thereby, in the pixel circuits 11 of the third block to the 54-th block, the grayscale signal is applied to the gate of the drive transistor QP1, and the holding capacitor Cpix is charged to the grayscale voltage (the writing periods of the third block to the 54-th block). When the writing of the grayscale signal to the pixel circuits 11 in the i-th row is completed, the gate line drive circuit 40 deactivates the scanning signal Gwr(i) that is supplied to the i-th row scanning line 12 to the high level.

After the (i+1)-th horizontal synchronization period in one vertical synchronization period ends, the gate line drive circuit 40 activates the control signal Gel(i) that is supplied to the i-th row control line 16 to the low level, and the deactivates the control signal Gorst(i) that is supplied to the i-th row control line 17 to the high level. Thereby, in the (i+2)-th horizontal synchronization period and after that, the transistor QP4 becomes the on state and the transistor QP5 becomes the off state, and the drive transistor QP1 supplies a current to the light emitting element D1 in accordance with the grayscale signal. Accordingly, the light emitting element D1 of the i-th row pixel circuit 11 emits light (the light emission period).

In this manner, the drive periods (the initialization period, the compensation period, and the writing period) of the i-th row pixel circuit 11 are provided in the i-th horizontal synchronization period, and the light emission periods of the pixel circuit 11 in the i-th row are provided in the (i+2)-th horizontal synchronization period and after that. Subsequently, after one vertical synchronization period has passed from the start of the drive period, the drive periods are provided again for one line.

With this embodiment, the grayscale data that is latched by a plurality of latch circuits 31 for each block is converted to a plurality of analog grayscale signals, and a plurality of data lines 13 in the display section 10 are sequentially driven for each block. Accordingly, it is possible to reduce the number of latch circuits 31, DACs 32, and amplifiers 33 so as to reduce the chip size. As a result, it is possible to reduce the cost of the display device.

However, if a plurality of amplifiers 33 are disposed outside the silicon chip and are connected to the scanner circuit 34 through the FPC board, or the like, distortion of the analog grayscale signal occurs, which affects image quality. In particular, if a high definition panel is used, the influence on the image quality becomes large. In this embodiment, the plurality of amplifiers 33 are mounted on the silicon chip, and thus the influence on the image quality becomes insignificant.

Figure 5A:
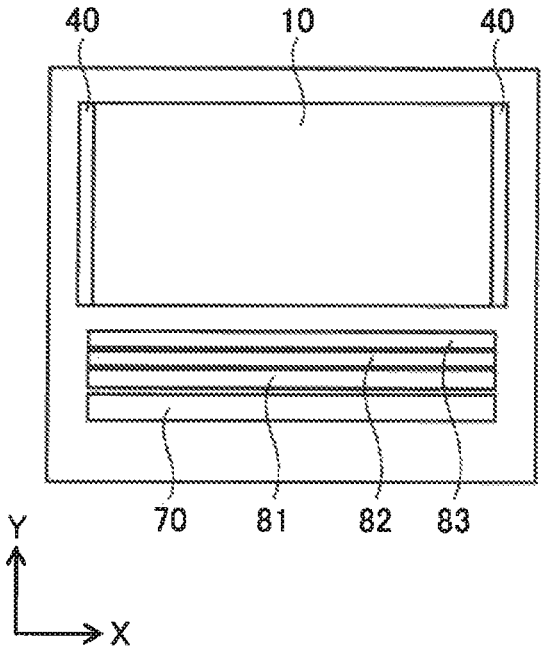
FIGS. 5A and 5B are plan views illustrating the layouts of the related-art display device and the display device according to the first embodiment respectively in comparison with each other.
Figure 5B:
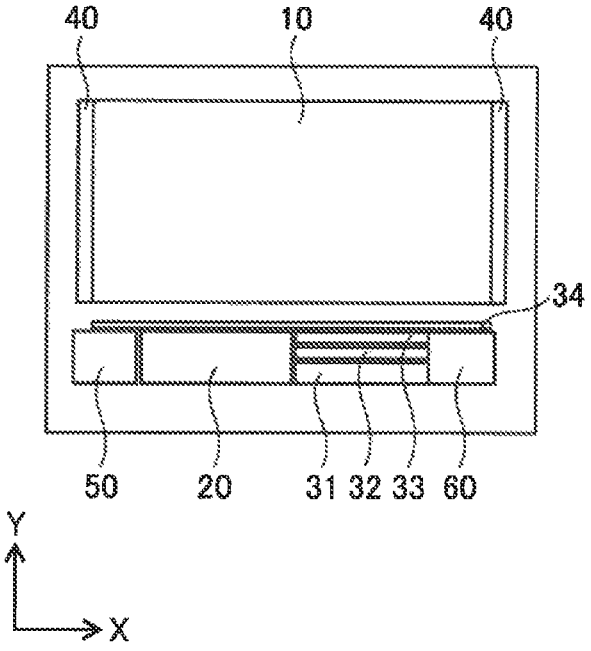

FIGS. 5A and 5B are plan views illustrating the layouts of the related-art display device and a display device according to the first embodiment of the invention respectively in comparison with each other. FIG. 5A illustrates the layout of the related-art display device that is driven by a demultiplexer driving method, in which 18 data lines are driven in time division by one amplifier. FIG. 5B illustrates the layout of the display device according to the first embodiment of the invention.

It is necessary to have a certain distance (for example, about 1.3 mm) between each side of the silicon chip and the display section 10 by restrictions for sealing the OLED and etching the glass. Under the restrictions, the gate line drive circuits 40 are disposed on both sides of the display section 10 in the X-axis direction, and the data line drive circuit is disposed on one side (the lower side in FIG. 5B) of the display section 10 in the Y-axis direction.

As illustrated in FIG. 5A, in the related-art display device, a plurality of amplifiers 83, a plurality of DACs 82, a plurality of latch circuits 81, and a display control circuit 70 are disposed in this order from closer position to the display section 10 in the four areas that extend in the longitudinal direction (in the X-axis direction of FIG. 5A) in the display section 10.

As illustrated in FIG. 5B, in the display device according to the first embodiment, a scanner circuit 34 is disposed in a first area in the longitudinal direction (in the X-axis direction of FIG. 5B) of the display section 10. For example, the output circuits 37, the selection circuit 36, and the plurality of transmission paths 35 that are illustrated in FIG. 2 are disposed in this order from closer position to the display section 10.

Also, the display control circuit 20 and the plurality of latch circuits 31 to the plurality of amplifiers 33 are disposed in order in the second area and the third area that are adjacent to the first area on the opposite side of the display section 10. For example, in the third area, the plurality of amplifiers 33, the plurality of DACs 32, and the plurality of latch circuits 31 are disposed in this order from the closer position from the display section 10.

In the first embodiment, the length between a plurality of latch circuits 31 to a plurality of amplifiers 33 in the X-axis direction is shortened to ⅓ the length of those in the related-art. Accordingly, it becomes possible to dispose the display control circuit 20 and the plurality of latch circuits 31 to the plurality of amplifiers 33 in order in the X-axis direction. Thereby, it is possible to reduce the chip size by the width of the display control circuit 20 or the width of the plurality of latch circuits 31 to the plurality of amplifiers 33 in the direction perpendicular to the longitudinal direction (the Y-axis direction) of the display section 10. Further, as illustrated in FIG. 5B, a temperature compensation circuit 50 and a stabilized power source circuit (including an electrostatic protection circuit) 60 may be disposed in an empty space in the X-axis direction.

FIG. 6 is a diagram illustrating a comparison between the width of each section of the display device according to the first embodiment and the width of each section of the related-art display device. FIG. 6 illustrates the width of each section of the data line drive circuit and the width of the display control circuit. It is assumed that the display control circuit is constituted by a gate array (G/A). Also, the width of each section is the width in the Y-axis direction illustrated in FIGS. 5A and 5B.

In the first embodiment, the width of the plurality of DAC 32 is reduced from the related-art 450 μm to 225 μm. This is because the length of the grayscale wiring line of the DAC 32 becomes short, and thus a double of circuits that have been necessary in the related art becomes one circuit. The scanner circuit having the width of 200 μm newly becomes necessary. However, as illustrated in FIG. 5B, the display control circuit 20 and the plurality of latch circuits 31 to the plurality of amplifiers 33 are disposed in order in the X-axis direction so that the width of the display control circuit 20 does not influence the total.

As a result, in the related-art display device, the total of the width of each section of the data line drive circuit and the width of the display control circuit is 4195 μm, whereas in the first embodiment, the total of the width of each section of the data line drive circuit and the width of the display control circuit becomes 3270 μm. Accordingly, it is possible to reduce the chip size in the Y-axis direction by about 925 μm.

Second Embodiment

Figure 7:
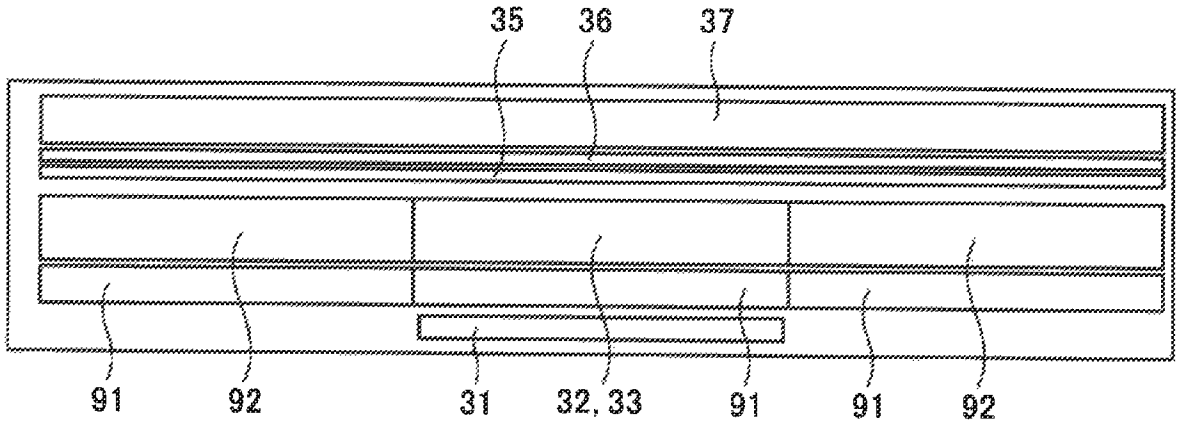
FIG. 7 is a plan view illustrating the layout of a part of a display device according to a second embodiment of the invention.

FIG. 7 is a plan view illustrating a layout of a data line drive circuit of a display device according to a second embodiment of the invention. The data line drive circuit of the display device according to the second embodiment includes components used by a demultiplexer driving method in addition to components used by a scan drive method. Regarding the other points, the second embodiment may have the same configuration as that of the first embodiment. In the following description, it is assumed that 5832 data lines are divided into 54 blocks, and one block includes 108 data lines.

As illustrated in FIG. 7, the data line drive circuit includes 108 pairs of two-stage latch circuits 31, 108 conversion circuits (DACs 32 and amplifiers 33), 108 transmission paths 35, the selection circuit 36, and the output circuit 37 because of the scan drive method. Among these, the 108 conversion circuits 32 and 33 are also used by the demultiplexer driving method. Also, the output circuit 37 includes a plurality of switch circuits and a plurality of capacitors that are used by the demultiplexer driving method.

Also, the data line drive circuit further includes 1944×3 pairs of two-stage latch circuits 91 and 108×2 conversion circuits (DACs and amplifiers) 92 because of the demultiplexer driving method. With the second embodiment, it is possible to separately use the scan drive method or the demultiplexer driving method depending on the application. On the other hand, if the demultiplexer driving method is not used, it becomes possible to reduce at least 1944×3 pairs of two-stage latch circuits 91 and 108×2 conversion circuits 92.

Electronic Apparatus

Next, a description will be given of an electronic apparatus including a display device according to any one of the embodiments of the invention. The display device 1 illustrated in FIG. 1 has small-sized pixels, and is suitable for a high-definition display. Accordingly, a description will be given by taking a head mounted display as an example of an electronic apparatus.

Figure 8:
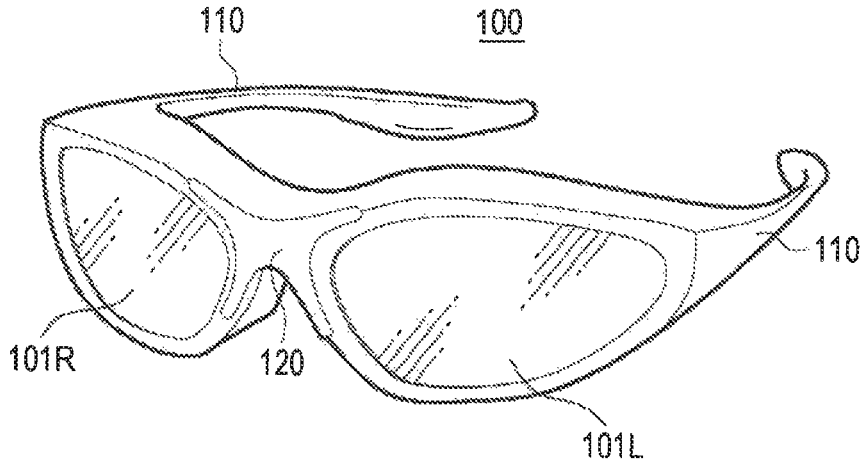
FIG. 8 is a perspective view illustrating an outer view of a head mounted display.
Figure 9:
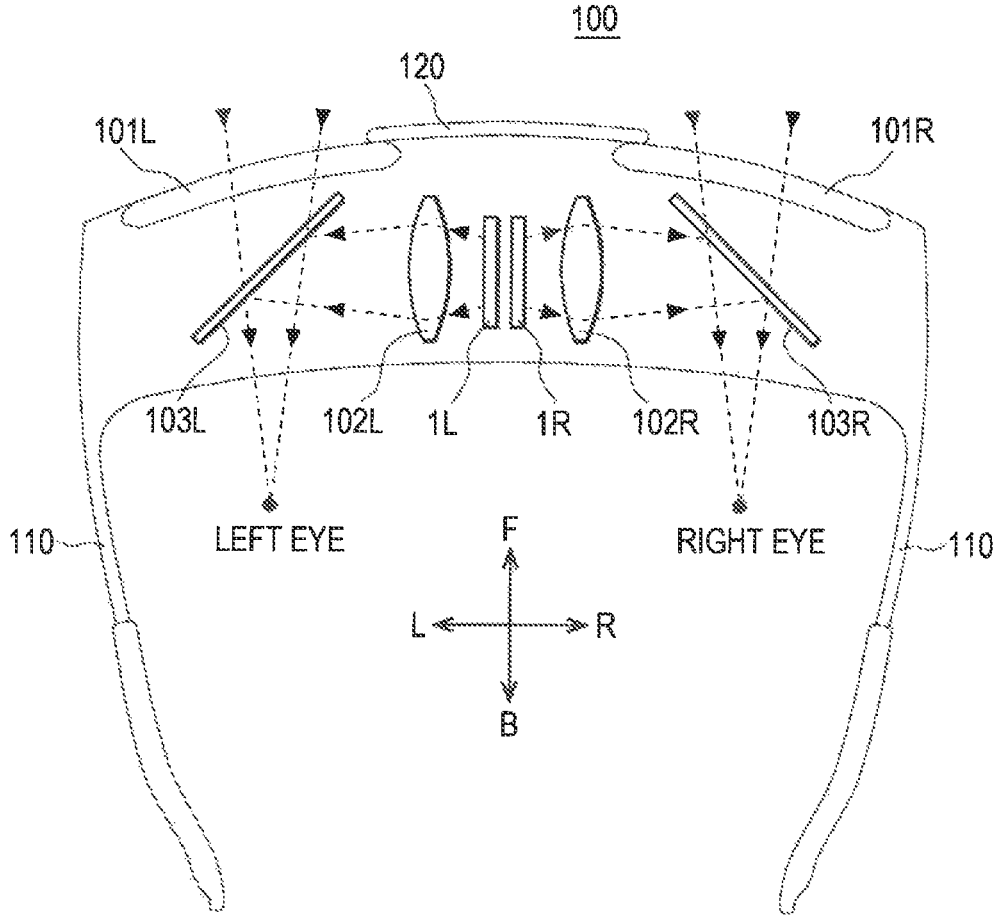
FIG. 9 is a plan view illustrating an example of an optical configuration of the head mounted display.

FIG. 8 is a perspective view illustrating an outer view of a head mounted display. FIG. 9 is a plan view illustrating an example of an optical configuration of the head mounted display. As illustrated in FIG. 8, a head mounted display 100 includes a temple 110, a bridge 120, and lenses 101L and 101R in the same manner as general glasses. Also, as illustrated in FIG. 9, the head mounted display 100 is provided with a left-eye display device 1L and a right-eye display device 1R in the vicinity of the bridge 120 and the inner side of the lenses 101L and 101R (the lower side of FIG. 9).

The image display surface of the display device 1L is disposed on the left side in FIG. 9. Thereby, the display image of the display device 1L outgoes in the L direction in FIG. 9 through an optical lens 102L. A half mirror 103L reflects the display image of the display device 1L in the B direction in FIG. 9 and transmits the incident light from the F direction in FIG. 9 at the same time.

The image display surface of the display device 1R is disposed on the right side in FIG. 9 on the contrary to the display device 1L. Thereby, the display image of the display device 1R outgoes in the R direction in FIG. 9 through an optical lens 102R. A half mirror 103R reflects the display image of the display device 1R in the B direction in FIG. 9 and transmits the incident light from the F direction in FIG. 9 at the same time.

With such a configuration, it is possible for a user of the head mounted display 100 to observe the display images of the display devices 1L and 1R in a see-through state of being superimposed on the external scenery. Also, in the head mounted display 100, a left-eye image out of a binocular image involving a binocular disparity is displayed on the display device 1L, and a right-eye image is displayed on the display device 1R so that it is possible for the user to perceive a displayed image as if the displayed image has a depth and a stereoscopic effect (3D display).

It is possible for the display device 1 illustrated in FIG. 1 to be applied to an electronic apparatus, such as an electronic viewfinder, and the like in a video camera or a lens interchangeable digital camera in addition to the head mounted display 100. With this embodiment, it is possible to reduce the size or the cost of an electronic apparatus by using a display device having a chip size reduced by reducing the number of latch circuits, and the like.

In the above-described embodiments, a description has been given of the case of using an OLED as a light emitting element. However, in this invention, it is possible to use a light emitting element that emits light with the luminance in accordance with a current, for example as an inorganic light emitting diode or a light emitting diode (LED), and the like. In this manner, the invention is not limited to the embodiments described above. It is possible for those skilled in the art to make many variations within the spirit and scope of the invention.

The entire disclosure of Japanese Patent Application No. 2016-029937, filed Feb. 19, 2016 is expressly incorporated by reference herein.

What is claimed is:

1. A display device including at least a display section and a drive circuit mounted on a same semiconductor substrate, the display section provided with a plurality of data lines correspondingly to a plurality of columns of pixel circuits, the drive circuit comprising:

in order to drive the plurality of data lines in sequence for each block, a plurality of latch circuits configured to latch grayscale data for each block;

a plurality of conversion circuits equal to a number of data lines in one block and configured to convert the grayscale data latched in the plurality of latch circuits into a plurality of analog grayscale signals, one block includes at least two data lines that are adjacent to each other, a plurality of transmission paths equal to the number of data lines in one block and configured to transmit the respective plurality of analog grayscale signals;

a selection circuit configured to generate a plurality of selection signals that select the data lines in the one block in sequence out of the plurality of data lines; and an output circuit connected between the plurality of transmission paths and the data lines in each block, and configured to output the plurality of analog grayscale signals to the data lines in the one block selected in sequence by the plurality of selection signals;

wherein data signals are sent through a second block only after signals are sent through each of the adjacent data lines in the one block, and wherein the drive circuit drives the data lines in the one block selected in sequence out of a plurality of blocks in one of a plurality of predetermined periods in one horizontal synchronization period.

2. The display device according to claim 1, wherein the display control circuit that controls display timing in the display section, and the plurality of conversion circuits and the plurality of latch circuits are disposed side by side in the second area and the third area that are adjacent to the first area respectively on the opposite side of the display section.

3. The display device according to claim 1, wherein the plurality of latch circuits include a first group of latch circuits disposed correspondingly to the number of data lines in one block and configured to capture grayscale data used for driving the data lines in one block in each of a plurality of predetermined periods in one horizontal synchronization period, and a second group of latch circuits disposed correspondingly to the number of data lines in one block and configured to hold the grayscale data output from the first group of latch circuits for each of the predetermined periods.

4. The display device according to claim 3, wherein the plurality of conversion circuits convert the grayscale data held in the second group of latch circuits into a plurality of analog grayscale signals for each of the predetermined period, the selection circuit generates a plurality of selection signals that sequentially selects data lines in one block from the plurality of data lines for each of the predetermined period, and the output circuit outputs the plurality of grayscale signals to data lines in one block selected in sequence by the plurality of selection signals for each of the predetermined period.

5. The display device according to claim 3, further comprising:

a gate line drive circuit configured to generate a scanning signal on the basis of timing when the first group of latch circuits start capturing the grayscale data in one horizontal synchronization period.

6. A display device including at least a display section and a drive circuit mounted on a same semiconductor substrate, the display device comprising:

a plurality of data lines separated into blocks for each predetermined number of lines, one block includes at least two data lines that are adjacent to each other; and a pixel circuit connected to any one of the plurality of data lines and disposed in the display section, wherein the drive circuit includes a number of circuits equal to the predetermined number of lines and a selection circuit configured to generate a selection signal that selects the plurality of data lines for each block in sequence out of the plurality of data lines, and each of the number of circuits includes a latch circuit configured to latch grayscale data, a conversion circuit configured to convert the grayscale data latched in the latch circuit into an analog grayscale signal, a transmission path for transmitting the grayscale signal, and an output circuit connected between any one of the data lines in the plurality of data lines and the transmission path, and controlled by the selection signal in the one block selected in sequence by the plurality of selection signals, wherein data signals are sent through a second block only after signals are sent through each of the adjacent data lines in the one block, and wherein the drive circuit drives the data lines in the one block selected in sequence out of the blocks in one of a plurality of predetermined periods in one horizontal synchronization period.

7. An electronic apparatus including the display device according to claim 1.

8. An electronic apparatus including the display device according to claim 2.

9. An electronic apparatus including the display device according to claim 3.

10. An electronic apparatus including the display device according to claim 4.

11. An electronic apparatus including the display device according to claim 5.

12. An electronic apparatus including the display device according to claim 6.

* * * * *